United States Patent [19]

Brownlee et al.

[11] 4,298,406

[45] Nov. 3, 1981

[54] MANUFACTURE OF STEEL PRODUCTS

[75] Inventors: Malcolm Brownlee, Middlesbrough; Thomas C. Harrison, Bishop Aukland, both of England

[73] Assignee: British Steel Corporation, London, England

[21] Appl. No.: 93,226

[22] Filed: Nov. 13, 1979

Related U.S. Application Data

[63] Continuation-in-part of Ser. No. 918,577, Jun. 23, 1978, abandoned.

[30] Foreign Application Priority Data

Nov. 3, 1977 [GB] United Kingdom ..... 45765/77

[51] Int. Cl.[3] ..... C21D 1/25; C21D 8/08

[52] U.S. Cl. ..... 148/12 B; 148/39

[58] Field of Search ..... 148/12 B, 12.4, 39, 148/134, 145, 153, 156, 157

[56] References Cited

U.S. PATENT DOCUMENTS 3,231,432 1/1966 McLean et al. ..... 148/12 B
3,926,689 12/1975 Respen et al. ..... 148/143
3,933,534 1/1976 Ettenreich et al. ..... 148/39
3,939,015 2/1976 Grange ..... 148/156
4,016,009 4/1977 Economopolous et al. ..... 148/156
4,108,695 8/1978 Paulitsch et al. ..... 148/39

FOREIGN PATENT DOCUMENTS 2345738 2/1977 Fed. Rep. of Germany ..... 148/39

*Primary Examiner*—Peter K. Skiff
*Attorney, Agent, or Firm*—Bacon & Thomas

[57] ABSTRACT

A process for the production of welded mesh suitable for the reinforcement of concrete. Rod exiting from the finishing stand of a hot mill is superficially cooled in a water quench to an equalization temperature of between 300° C. and 700° C. The rod is then further cooled in air to temper the bainitic or martensitic outer surface layer so produced, and is then arranged to form a mesh and welded at the overlaps. No drawing or mechanical working of the rod takes place between cooling and forming the mesh.

8 Claims, 1 Drawing Figure

DISTRIBUTION OF $\frac{\text{UTS}-\text{PROOF STRESS}}{\text{PROOF STRESS}} \times 100$ VALUES FROM HARD DRAWN WIRE AND ENHANCED COOLED ROD FABRICS

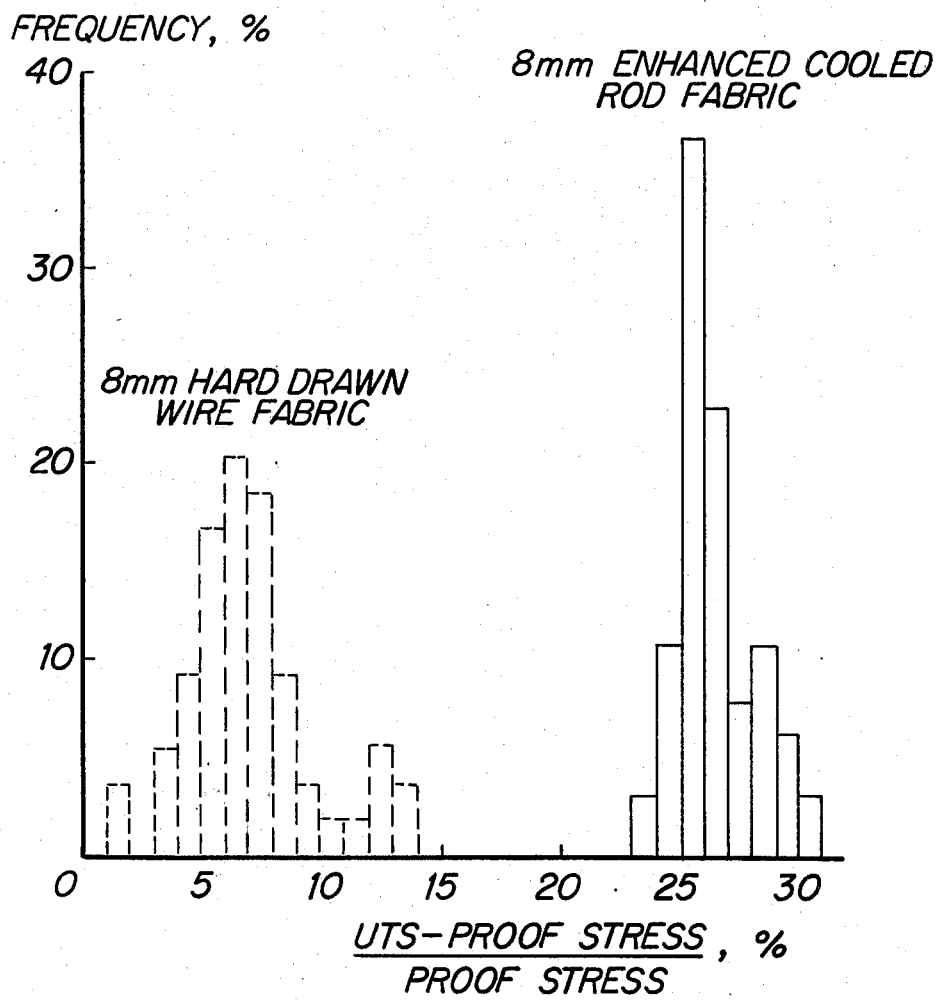
DISTRIBUTION OF $\frac{\text{UTS}-\text{PROOF STRESS}}{\text{PROOF STRESS}} \times 100$ VALUES FROM HARD DRAWN WIRE AND ENHANCED COOLED ROD FABRICS

MANUFACTURE OF STEEL PRODUCTS

This invention relates to the manufacture of steel products and is a continuation-in-part of our application Ser. No. 918,577 filed on June 23, 1978, abandoned. In particular it is concerned with the manufacture of steel wire or rod and its incorporation into a welded mesh suitable for the reinforcement of concrete.

In our co-pending application Ser. No. 917,272 a process is described for the production of a high strength steel rod in coil form. The present invention concerns a development of this process.

According to this invention there is provided a process for the production of welded steel mesh for the reinforcement of concrete, including the steps of hot rolling in a rolling mill carbon-manganese steel rod having a manganese content of not more than about 0.78%, the rod exiting from the last stand of the mill with a temperature in excess of 1000° C., superficially cooling the rod in water from this temperature to an equalisation temperature between 300° C. and 700° C. so as to produce a martensitic or bainitic outer surface layer, laying the rod on a moving conveyor in the form of flat overlapping non-concentric rings, cooling the rod in air on the conveyor so as to temper the martensitic or bainitic layer, collecting the rings in coils and without effecting any drawing or mechanical working on the rod arranging the rod in the form of a mesh, and welding the lengths of rod to one another where the rods overlap.

The rod cooling on the moving conveyor may be carried out in substantially still air, a certain amount of forced air cooling may be provided, however, particularly towards the end of the moving conveyor, to enable the coils to be satisfactorily handled thereafter.

The rod may be at least 5 mm in diameter and not greater than 15 mm in order for it to be coiled (and subsequently de-coiled without the need for expensive de-coiling equipment) and may consist of a carbon-manganese steel with a carbon content of between 0.05% and 0.5% and manganese between 0.5% and 0.8%. Preferably the carbon content is between 0.08% and 0.35% with the mangenese between the aforesaid range. The steel may be produced in a balanced (semi-killed) or killed form.

The rod may be straightened and cut into suitable lengths prior to forming the mesh. Alternatively, with automatic mesh-forming machines, the rod may be fed from individual coils and aligned to form a mesh, welded at the overlaps, and then cut adjacent each coil to free the newly formed mesh.

The process may include the forming of projections on the surface of the rod during the rolling process; rolling speeds of the order of 12,000 ft/minute (5.5 mm dia.), 8,000 ft/minute (9.5 mm dia) and 3,500 ft/minutes (15 mm dia), may be obtained.

The rod produced in accordance with this invention possesses strength levels at least as good as conventionally produced drawn wire, i.e. rod which has been subjected to a drawing step after issuing from the mill, and much improved ductility levels over this product. Furthermore, these strength levels are achieved with a composition having a much lower manganese content than was required for material processed to produce equivalent properties. The lower manganese content provides a lower cost product but more importantly enhances weldability which is particularly beneficial in the production of mesh, of course. Indeed with welded mesh stress relieving treatments are frequently performed on the whole completed fabric to ensure that the required tensile/yield ratio and ductility are obtained. This is a very expensive procedure which can now be avoided in accordance with this invention since the properties achieved in the rod and subsequent mesh already attain the levels required which, so far as building regulations are concerned is principally that any structural failures will occur by progressive collapse, this being ensured by adequate ductility of the steel and/or a minimum value by which the ultimate failure load exceeds the yield load.

In short, enhanced cooled steel rod made up into welded mesh in accordance with this invention meets all the property requirements of hard drawn wire utilised for this purpose and can be produced on a commercial scale by a cheaper and much faster process route. For example, with reference to the U.S. standard specification for cold-drawn steel wire for concrete reinforcement ANSI/ASTM A 82-76 all size no's between W26 (≏15 mm) and W35 (≏5 mm) can be produced in rod of comparable or improved properties without the need for drawing into wire. Likewise, with regard to the tension test requirements in Table 1 (less severe than Table 2—welded fabric wire) the reduction of area to fracture—ductility—is much higher than the minimum value there stated (30%) and this we achieve with much higher strength levels in addition.

In one particular example of the operation of this process a mild steel rod including 0.25% carbon and 0.8% manganese issued through the last stand 15 mm in diameter at about 1050° C. The rod was rapidly quenched in water and laid on a moving conveyor at about 400° C. in the form of flat, overlapping non-concentric rings and then subjected to air cooling to temper the martensitic surface layer produced during the water quench. Subsequently the rod was taken up in the form of a coil and then cut to length aligned to form a mesh and welded at the overlaps. Tests conducted on the rod lengths gave tensile strength as 740 N/mm$^2$, 0.2% proof stress as 560 N/mm$^2$ and percentage reduction to fracture as 60. Typical examples of steels treated according to the invention and the resultant properties of the rod thereby produced, are given in the following table.

| No. | % C | % Mn | Rod Diameter mm | Laying Temp. °C. | Tensile Strength N/mm$^2$ | 0.2% Proof Stress N/mm$^2$ | % Reduction of Area to Fracture | % Elongation |
|---|---|---|---|---|---|---|---|---|
| 1 | 0.11 | 0.52 | 5.5 | 350 | 650 | 602 | 76 | 18 |
| 2 | 0.18 | 0.78 | 8.0 | 680 | 605 | 520 | 70 | — |
| 3 | 0.20 | 0.70 | 9.5 | 650 | 640 | 545 | 72 | — |
| 4 | 0.25 | 0.59 | 8.0 | 700 | 719 | 532 | 69 | 21 |
| 5 | 0.30 | 0.55 | 8.00 | 700 | 750 | 600 | 68 | 17 |

In each of the examples given it will be seen that the rod is cooled to below its transformation temperature before the commencement of laying. It should be noted that in the mill configuration employed, the laying temperature corresponds approximately to the equalisation temperature of the rod, the rings being re-formed into coils at a temperature at least 100° C. less than that at which they are laid. The finish rolling temperature in each example in the table, as with the first one given, was approximately 1050° C.

As mentioned, these rods can be straightened and cut into length and used directly for the manufacture of mesh for concrete reinforcement without any cold drawing or further mechanical working. With the composition used there is no problem in welding the mesh, and the strength levels are at least as good as conventionally produced cold drawn steel rod or wire which has been used hitherto for reinforcement meshes. Tests conducted on 8 mm diameter rod mesh containing 0.2% carbon and 0.56 manganese, laid at 700° C., indicated that the position of fracture is away from the weld region, the tensile strength being 740 Newtons/mm$^2$, the 0.2% proof stress being 600 Newtons/mm$^2$ and the elongation 19%.

More importantly, mesh fabric constructed from enhanced cooled rod in the manner of this invention consistently gives a bigger difference between ultimate tensile strength and proof stress than hard drawn wire fabric which, as mentioned above, better ensures that any structural failure will occur by progressive collapse. The smaller this difference the more rapid and sudden is failure once the proof stress has been reached. These superior properties of the product according to this invention are exemplified in the accompanying drawing which illustrates a histogram of what is essentially a measurement of the degree by which additional stresses may be placed on the fabric before the ultimate in tensile strength is reached (along the abscissa) plotted against the frequency with which these figures are obtained.

We claim:

1. A process for the production of welded steel mesh for the reinforcement of concrete, including the steps of hot rolling in a rolling mill semi-killed or killed carbon-manganese steel rod having a manganese content of not more than about 0.78%, the rod exiting from the last stand of the mill with a temperature in excess of 1000° C., superficially cooling the rod in water from this temperature to an equalisation temperature between 300° C. and 700° C. so as to produce a martensitic or bainitic outer surface layer, laying the rod on a moving conveyor in the form of flat overlapping non-concentric rings, cooling the rod in air on the conveyor so as to temper the martensitic or bainitic layer, collecting the rings in coils and without effecting any drawing or mechanical working on the rod, arranging the rod in the form of a mesh, and welding the lengths of rod to one another where the rods overlap.

2. A process according to claim 1 in which the rod is cooled in air as it passes along the conveyor.

3. A process according to claim 2 in which the cooling on the moving conveyor is carried out in substantially still air.

4. A process according to claim 3 in which the non-concentric rings are reformed into coils at a temperature of at least 100° C. less than the temperature at which they are laid.

5. A process according to claim 1 including forming projections on the surface of the rod during hot rolling.

6. A process according to claim 1 including straightening the rod prior to cutting into suitable lengths for the mesh to be constructed.

7. A process according to claim 1 in which the rod is a carbon-manganese steel with a carbon content of between 0.05% to 0.5% and a manganese content of between 0.52% and 0.78%.

8. A process according to claim 7 in which the steel has a carbon content of between 0.08% and 0.35%.

* * * * *